US007389075B2

(12) United States Patent
Takahashi et al.

(10) Patent No.: US 7,389,075 B2
(45) Date of Patent: Jun. 17, 2008

(54) IMAGE FORMING APPARATUS, PROGRAM AND POSITIONAL ERROR CORRECTION METHOD

(75) Inventors: Toshiyuki Takahashi, Kanagawa (JP); Tadashi Shinohara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 631 days.

(21) Appl. No.: 10/886,560

(22) Filed: Jul. 9, 2004

(65) Prior Publication Data

US 2005/0009351 A1 Jan. 13, 2005

(30) Foreign Application Priority Data

Jul. 9, 2003 (JP) ..... 2003-194584

(51) Int. Cl.
*G03G 15/01* (2006.01)
*G03G 15/00* (2006.01)

(52) U.S. Cl. ..... 399/301; 399/49; 399/299; 399/303

(58) Field of Classification Search ..... 399/46, 399/49, 301, 302, 299, 303
See application file for complete search history.

(56) References Cited

U.S. PATENT DOCUMENTS 5,621,221 A 4/1997 Shinohara et al.
5,737,665 A 4/1998 Sugiyama et al.
5,765,083 A 6/1998 Shinohara
5,875,380 A 2/1999 Iwata et al.
5,899,597 A 5/1999 Shinohara et al.
5,962,783 A 10/1999 Iwata et al.
5,963,240 A 10/1999 Shinohara et al.
6,118,557 A 9/2000 Sugiyama et al.
6,128,459 A 10/2000 Iwata et al.
6,282,396 B1 8/2001 Iwata et al.

(Continued)

FOREIGN PATENT DOCUMENTS

JP 6-253151 9/1994

(Continued)

OTHER PUBLICATIONS

U.S. Appl. No. 10/041,640, filed Jan. 10, 2002, Yamanaka et al.

(Continued)

*Primary Examiner*—Hoang Ngo
(74) *Attorney, Agent, or Firm*—Oblon, Spivak, McClelland, Maier & Neustadt, P.C.

(57) ABSTRACT

An image forming apparatus includes an electrophotographic process part for image formation provided for an image carrying medium for each color; a non-end moving part moving images transferred thereto from the respective image carrying media for the respective colors; and an image detecting part detecting an image formed on the non-end moving part. The respective electrophotographic process parts are disposed in sequence along the non-end moving part, and form positional error detection marks on the non-end moving part; the image detecting part detects the thus-formed positional error detection marks; and positional error correction is performed based on a result of detection thus performed by the image detecting part. The apparatus comprises a control part having at least two modes in the positional error correction; and the control part performs control such that one of the at least two modes is selected according to a positional error amount detected by the image detecting part.

20 Claims, 5 Drawing Sheets

U.S. PATENT DOCUMENTS

| | | | |
|---|---|---|---|
| 6,295,435 | B1 | 9/2001 | Shinohara et al. |
| 6,380,960 | B1 | 4/2002 | Shinohara |
| 6,381,435 | B2 | 4/2002 | Shinohara et al. |
| 6,573,918 | B2 | 6/2003 | Kobayashi et al. |
| 6,587,137 | B2 | 7/2003 | Shinohara et al. |
| 6,693,654 | B2 | 2/2004 | Shinohara |
| 6,704,035 | B2 | 3/2004 | Kobayashi et al. |
| 6,711,364 | B2 | 3/2004 | Shinohara |
| 6,714,224 | B2 | 3/2004 | Yamanaka et al. |
| 2005/0009351 | A1 | 1/2005 | Takahashi et al. |

FOREIGN PATENT DOCUMENTS

| | | |
|---|---|---|
| JP | 9-204087 | 8/1997 |
| JP | 11-102098 | 4/1999 |
| JP | 2001-51478 | 2/2001 |

OTHER PUBLICATIONS

U.S. Appl. No. 10/320,399, filed Dec. 17, 2002, Shinohara.
U.S. Appl. No. 10/652,068, filed Sep. 2, 2003, Shinohara.
U.S. Appl. No. 10/886,560, filed Jul. 9, 2004, Takahashi et al.
U.S. Appl. No. 11/340,645, filed Jan. 27, 2006, Shinohara.
U.S. Appl. No. 11/496,510, filed Aug. 1, 2006, Shinohara.
U.S. Appl. No. 11/555,476, filed Nov. 1, 2006, Shinohara.
U.S. Appl. No. 11/557,289, filed Nov. 7, 2006, Unknown.

IMAGE FORMING APPARATUS, PROGRAM AND POSITIONAL ERROR CORRECTION METHOD

BACKGROUND OF THE INVENTION

The present application is based on the Japanese Priority Application No. 2003-194584, filed on Jul. 9, 2003, the entire contents of which are hereby incorporated by reference.

1. Field of the Invention

The present invention relates to an image forming apparatus forming a color image such as a copier, a printer, a facsimile machine or such in an electrophotographic type or an electrostatic recording type, a program applicable to such an image forming apparatus, and a positional error correction method applicable to such an image forming apparatus.

2. Description of the Relate Art

In the related art, a method for avoiding positional error which is error in mutual position in images of respective colors which should agree with each other to create a proper color image as a combination thereof otherwise causing color drift in a full-color image forming apparatus, is known. Specifically, for example, as one method, a series of toner marks are formed especially for the purpose of positional error detection.

Japanese Laid-open Patent Application No. 9-204087 discloses a method in which a plurality of types of marks for the detection are formed, by which information of periodic rotational variation of color registration drift is obtained. In this method, a plurality of sampling periods are prepared for the marks for the detection.

Japanese Laid-open Patent Application No. 11-102098 proposed by the present applicant discloses a configuration in which a detecting unit detecting positional error detection marks including lines along a main scan direction and those oblique with respect thereto includes slits in parallel to the respective marks, a light source part and a light receiving part.

SUMMARY OF THE INVENTION

However, in the related arts such as those described above, there is a possibility that those positional error detection marks cannot be detected when an amount of the actual positional error exceeds an expected value. For example, in the case of the art disclosed in Japanese Laid-open Patent Application No. 11-102098, the respective lines used as the positional error detection marks may not be properly detected when the positional error in an amount exceeding an expected level occurs.

The present invention has been devised in consideration of such a problem, and an object of the present invention is to provide an image forming apparatus in which such positional error detection marks can be positively detected even when an amount of the actual positional error increases.

Another object of the present invention is to provide an image forming apparatus in which it is possible to reduce a time required for correcting the positional error when the amount of the positional error is determined as significantly large.

According to the present invention, in an image forming apparatus including: an electrophotographic process part for image formation on an image carrying medium for each color; a non-end moving part moving images transferred thereto from the respective image carrying media for the respective colors; and an image detecting part detecting an image formed on the non-end moving part, the respective electrophotographic process parts are disposed in sequence along the non-end moving part, and form positional error detection marks on the non-end moving part; the image detecting part detects the thus-formed positional error detection marks; and positional error correction is performed based on a result of detection thus performed by the image detecting part, wherein: the apparatus comprises a control part having at least two modes in the positional error correction; and the control part performs control such that one of the at least two modes is selected according to a positional error amount detected by the image detecting part.

According to a second aspect of the present invention, the at least two modes include a large positional error mode which is applied when a positional error amount detected by means of the image detecting part is large and a small positional error mode which is applied when a positional error amount detected by means of the image detecting part is small; and in the large positional error mode, control is performed such that the positional error detecting marks formed by means of the respective electrophotographic process parts are longer or have longer spacing thereamong than those in the small positional error mode.

According to a third aspect of the present invention, the at least two modes of positional error correction are executed from at least one of a service mode or a user menu.

According to a fourth aspect of the present invention, the control part performs control such that the large positional error mode is executed automatically at predetermined timing.

According to a fifth aspect of the present invention, the predetermined timing includes timing immediately after a power supply to a body part of the apparatus is turned on and timing immediately after a predetermined unit concerning image formation in the apparatus is replaced.

According to a sixth aspect of the present invention, the control part performs control such that only a single set of the positional error detection marks are formed in the large positional error mode.

According to a seventh aspect of the present invention, the image detecting part includes a light source and a light receiving part; and the control part performs control such that an output signal of the light receiving part is sampled with a longer period when the positional error detection mark is detected by means of the image detecting part in the large positional error mode than that in the small positional error mode.

According to an eighth aspect of the present invention, the control part performs control such that a speed at which the non-end moving part moves when the electrophotographic process parts form the positional error detection marks on the non-end moving part is higher in the large positional error mode than that in the small positional error mode.

In the configuration according to the present invention, it is possible to provide an image forming apparatus in which the positional error detection marks can be positively detected even when the amount of the positional error increases.

Further, it is possible to reduce a time (adjustment time) required for correcting the positional error when it is determined that the positional error is larger than expected.

BRIEF DESCRIPTION OF THE DRAWINGS

Other objects and further features of the present invention will become more apparent from the following detailed description when read in conjunction with the accompanying drawings.

DETAILED DESCRIPTION OF THE PREFERRED EMBODIMENTS

Figure 1:
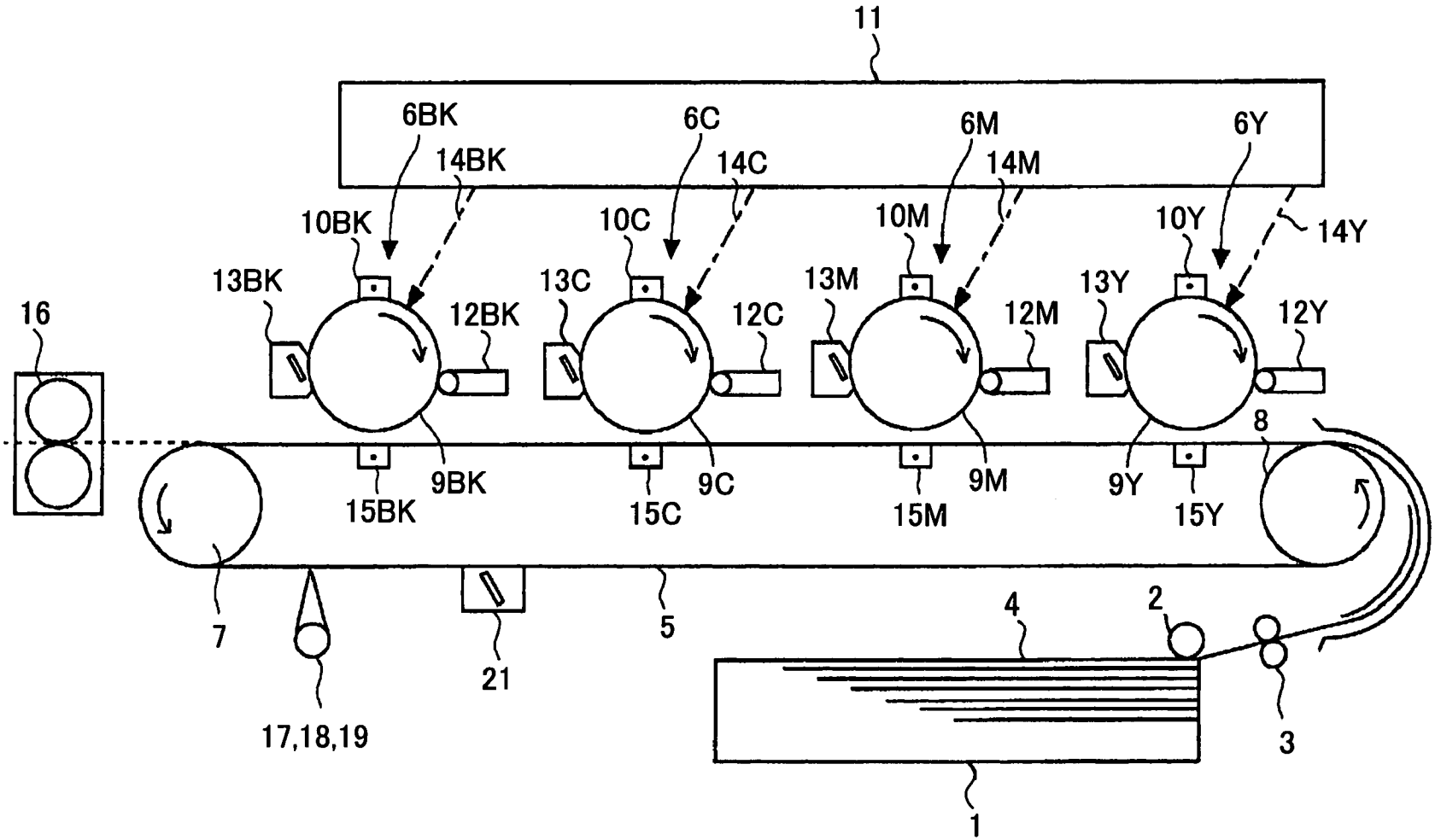
FIG. 1 shows a side-elevational view of a configuration of an image forming apparatus according to each embodiment of the present invention which performs image formation.

An image forming apparatus according to the present invention will now be described in detail with reference to the figures.

First, a common configuration of the image forming apparatus in respective embodiments of the present invention is described.

The image forming apparatus in each of the respective embodiments of the present invention has a configuration in which image forming parts for respective color (K, M, Y and C, described later) 6BK, 6M, 6M and 6Y are disposed along a conveyance belt (non-end moving part) 5 (see FIG. 1). Such a type of configuration is called a 'tandem type' in general.

That is, along the conveyance belt 5 which conveys paper (recording paper) 4 supplied by means of a paper supply roller 2 and separation rollers 3 from a paper supply tray 1, the plurality of image forming parts (photoelectric process parts) 6Y, 6M, 6C and 6BK are disposed in the stated order from an upstream end of a direction in which the paper 1 is conveyed by the conveyance belt 5.

The plurality of image forming parts 6Y, 6M, 6C and 6BK are common in their internal configuration except the respective colors of toner images formed on the conveyance belt 5 thereby. The image forming part 6Y forms a yellow (Y) image; the image forming part 6M forms a magenta (M) image; the image forming part 6C forms a cyan (C) image; and the image forming part 6BK forms a black (BK or K) image.

Therefore, only the image forming part 6Y is described specifically hereinafter, for the purpose of omitting duplicated description for the other image forming parts 6M, 6C and 6BK each having the same configuration as that of the image forming part 6Y. For respective elements of the image forming parts 6M, 6C and 6BK, letters such as M, C and BK are used, respectively, for the purpose of distinguishing thereamong, instead of Y, given to the respective elements in the image forming part 6Y.

The conveyance belt 5 is an endless (non-end) belt are wound on a driving roller 7, which is directly driven and rotated, and a following roller 8. The driving roller 7 is driven and rotated by a driving motor, not shown, and thus, the driving motor, the driving roller 7 and the following roller 8 act as a driving part for circularly moving the conveyance belt 5.

When image formation is performed in this image forming apparatus having the above-described configuration, paper, contained in the paper supply tray 1 is fed therefrom, sheet by sheet, in sequence from the top one, is caused to adhere to the conveyance belt 5 by means of an electrostatic absorption function, is then conveyed by the conveyance belt 5 which is driven and rotated as mentioned above toward the first image forming part 6Y, and there, a yellow toner image is formed thereby on the thus-conveyed paper.

The image forming part 6Y includes a photosensitive drum 9Y acting as a photosensitive body, as well as a charger 10Y, an exposure unit 11Y, a developer 12Y, a photosensitive body cleaner (not shown), an electricity remover 13Y and so forth, which are disposed around the photosensitive drum 9Y as shown. The exposure unit 11 (11Y, 11M, 11C or 11BK) is configured to emit laser light, which is exposure light corresponding to an image color Y, M, C or K formed by a relevant one of the respective image forming parts 6Y, 6M, 6C and 6BK.

When the image formation process is performed, an external cylindrical surface of the photosensitive drum 10Y is uniformly (electrically) charged by the charger 10Y in a dark state, then is exposed by laser light for an yellow image by the exposure unit 11Y, and thus, an electrostatic latent image is formed thereon. The developer 12Y changes the electrostatic latent image into a visual toner image by means of yellow toner, and thereby, an yellow toner image is formed on the photosensitive drum 9Y.

This toner image is transferred to the paper 4 at a position (transfer position) at which the photosensitive drum 9Y comes into contact with the paper 4 on the conveyance belt 5 by a function of a transfer unit 15Y. By this transfer action, the yellow toner image is formed on the paper 4. Useless toner left on the photosensitive drum 9Y from which the toner image has been thus transferred is then cleaned by means of the photosensitive drum cleaner. After that, the photosensitive drum 9Y undergoes an electricity removal process by means of the electricity remover 13Y, and then, stands ready for a subsequent image formation process.

The paper 4 to which the yellow toner image is thus transferred from the image forming part 6Y is then conveyed to the subsequent image forming part 6M by means of the conveyance belt 5. In the image forming part 6M, a magenta toner image is formed on the photosensitive drum 9M via the same process as that performed in the image forming part 6Y, and then, the magenta toner image is transferred to the paper 4 on the conveyance belt 5 in a manner of being superposed on the yellow toner image already formed thereon as mentioned above.

The paper 4 is then conveyed further to the further subsequent image forming parts 6C and 6BK in sequence also by means of the conveyance belt 5. In these image forming parts 6C and 6BK, a cyan toner image and a black toner image are formed on the photosensitive drums 9C and 9BK via the same processes as that performed in the image forming part 6Y, and then, the cyan and black toner images are transferred to the paper 4 also in a manner of being further superposed on the already formed toner images thereon. Thereby, finally a full-color image is formed on the paper 4 on the conveyance belt 5. The paper 4 on which the full-color superposed image is thus formed is removed from the conveyed belt 5, the image is fixed thereon by means of a fixing unit 16, and after that, the paper 4 is ejected from this image forming apparatus.

In the color image forming apparatus configured as described above, a problem may occur in which the toner images of the respective colors Y, M, C and K are not properly superposed on the paper 4 at a position at which they should be superposed, due to some reasons, such as positional error in inter-axis distance among the photosensitive drums 9Y, 9M, 9C and 9BK, error in parallelism among the photosensitive drums 9Y, 9M, 9C and 9BK, setting error of deflection mirrors therein (not shown) which deflect laser light in the exposure units 11, timing error in writing of the electrostatic latent images of the respective colors to the surfaces of the photosensitive drums 9Y, 9M, 9C and 9BK, or such.

As main factors of the above-mentioned positional error among the respective colors, a skew, registration drift in a sub-scan direction (indicated by an arrow SUB in FIG. 1), magnification error in a main scan direction (indicated by an arrow MAIN in FIG. 1), registration error in the main scan direction or such are known. When such a positional error among the respective colors occurs, 'color drift' may occur in which the proper color may not be represented on the full-color image finally formed on the conveyance belt 5 by means of the image forming units in the respective colors Y, M, C and K as mentioned above in the Background Art of the Invention.

In order to correct such positional error in the toner images of the respective colors so as to avoid the above-mentioned color drift, which may occur as described above, sensors 17, 18 and 19 are provided facing the conveyance belt 4 on the downstream side of the image forming part 6BK, as shown in FIG. 1. The sensors 17, 18 and 19 are supported on a common substrate in a manner such that they are disposed along the main scan direction perpendicular to the direction in which the paper 4 is conveyance by the conveyance belt 5.

Figure 2:
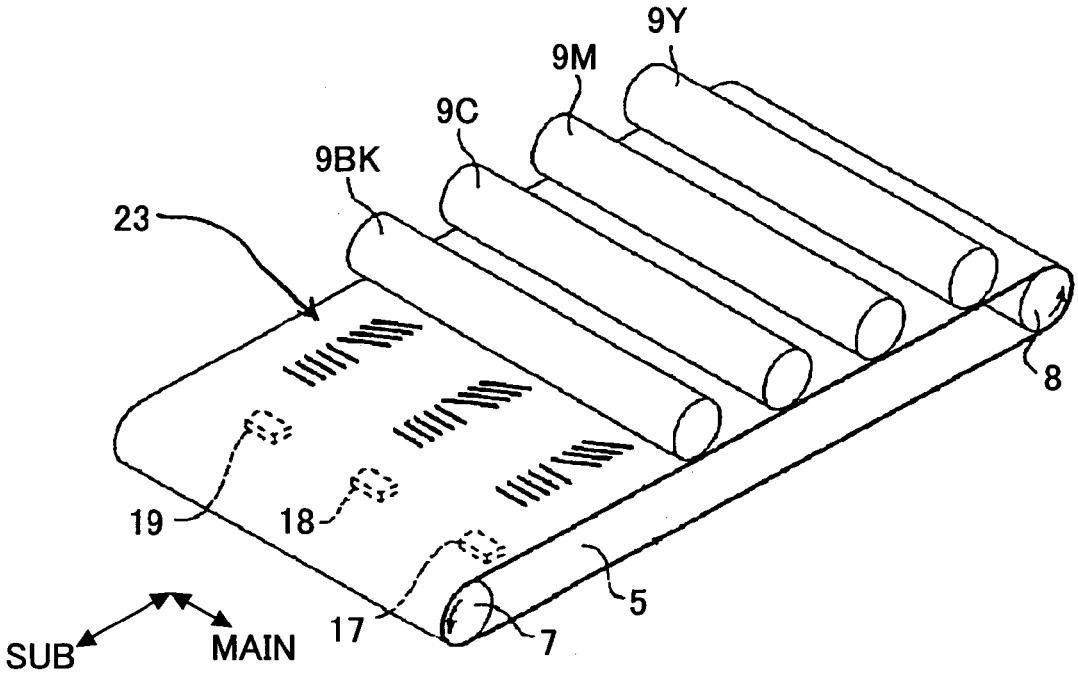
FIG. 2 shows a perspective view of a configuration in which positional error detection marks 23 are formed on a conveyance belt 5 in the configuration shown in FIG. 1.
Figure 3:
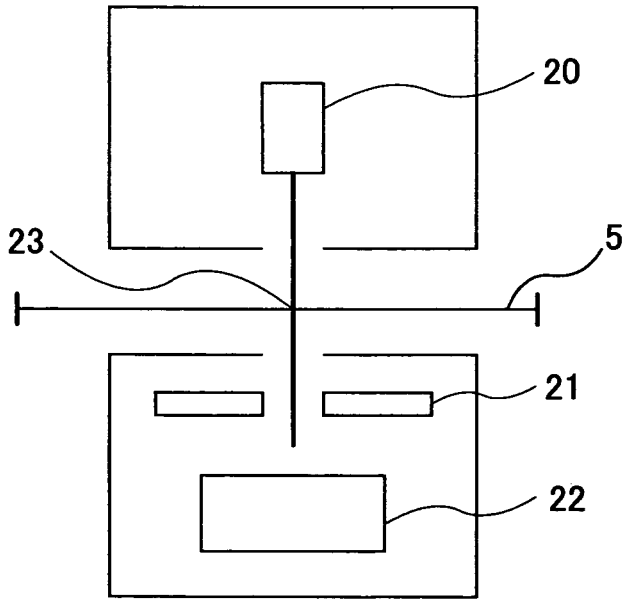
FIG. 3 shows a side-elevational sectional view of a configuration provided for detecting the detection marks 23 by means of a sensor (17, 18 or 19) in the configuration shown in FIG. 2.

FIG. 2 shows a part of the configuration shown in FIG. 1 in particular around the sensors (acting as image detecting parts) 17, 18 and 19 while FIG. 3 shows a magnified view of each image detecting part 17, 18 or 19. The image detecting part includes a light source unit 20, a slit member 21 and a light receiving unit 22, and detects positional error detection marks 23 formed on the conveyance belt 5 by means of the image forming units 6Y, 6M, 6C and 6BK via the processes described above with reference to FIG. 1. The image detecting parts (17, 18 and 19) are disposed at the center and both ends, respectively, in the main scan direction, and the above-mentioned detection marks 23 are formed for each of them, as shown in FIG. 2.

Figure 4:
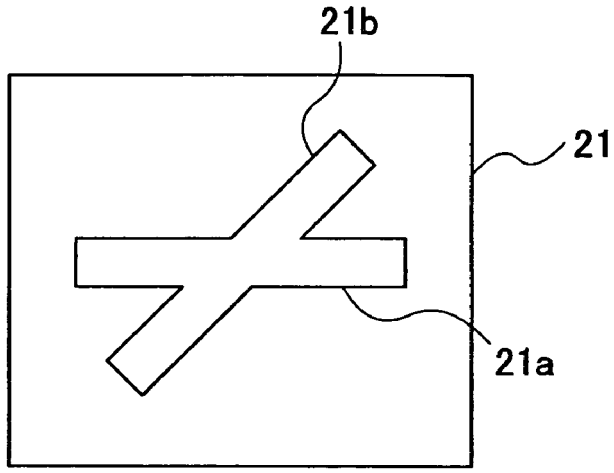
FIG. 4 shows a plan view of a slit member 21 shown in FIG. 3.

FIG. 4 shows a magnified view of the above-mentioned slit member 21. The slit member 21 has two slits 21*a* and 21*b*, i.e., a parallel slit 21*a* and an oblique slit 21*b*. The parallel slit 21*a* is parallel to the main scan direction for detecting parallel lines 23*a* of the above-mentioned positional error detection marks 23 formed in parallel to the main scan direction, while the oblique slit 21*b* is inclined from the main scan direction for detecting oblique lines 23*b* of the positional error detection marks 23 formed inclined from the main scan direction (see also FIG. 5).

Figure 5:
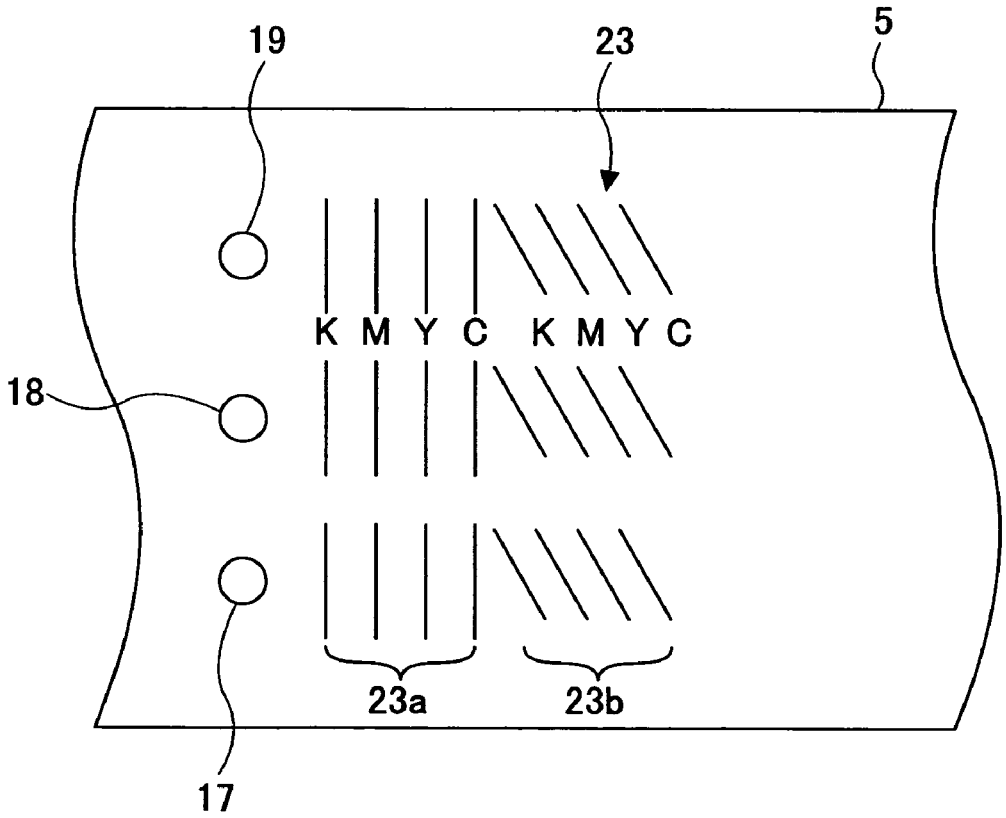
FIG. 5 shows the detection marks 23 formed on the conveyance belt 5 shown in FIG. 2.

FIG. 5 shows magnified view of the above-mentioned positional error detection marks 23. These detection marks 23 include the parallel lines 23*a* and the oblique lines 23*b*, mentioned above, for the respective colors K (BK), M, Y and C, as shown. In the image forming apparatus, control is made such that these lines 23 of the respective colors K, M, Y and C shown in FIG. 5 are formed by the respective image forming parts 6BK, 6M, 6Y and 6C. The control is made also such that target spacing among these lines of the detection marks 23 thus formed is set as a predetermined length 'd', for example.

By providing such a configuration, when one of the respective lines of these detection marks 23 thus formed on the conveyance belt 5 reaches a position of the above-mentioned slit member 21 of the sensor 17, 18 or 19 and thus this line is precisely aligned with a relevant slit of the slit member 21, i.e., when the line coincides with the relevant slit of the slit member 21, a detection signal thus obtained from the light receiving part 22 has a waveform of a hump or a hollow in a good shape, and thus, it is possible to accurately detect the center of each line of the detection mark 23 formed on the conveyance belt 5. By thus detecting the accurate positions of the lines of the positional error detection marks 23 by means of the respective sensors 17, 18 and 19, it is possible to detect positional error among the respective colors such as that described above.

Figure 6:
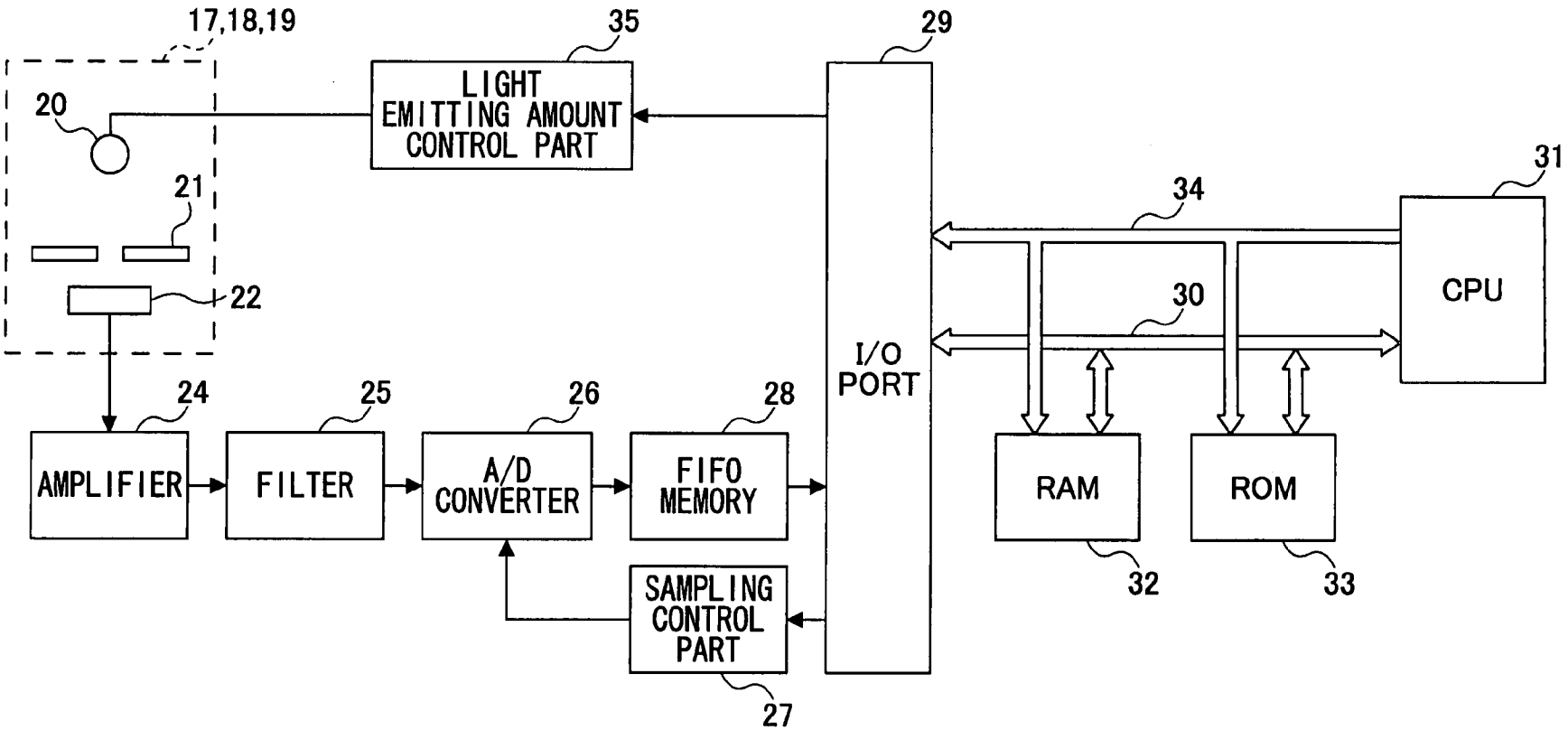
FIG. 6 shows a block diagram of a configuration for data processing in the image forming apparatus according to each embodiment of the present invention.

FIG. 6 shows a block diagram of part of the above-mentioned image forming apparatus for processing the thus-detected data according to the present invention.

In this configuration, a CPU 31 performs predetermined operation based on a result of detection the detection marks 23 so as to obtain respective amounts of skew, registration error in the sub-scan direction, magnification error in the main scan direction and registration error in the main scan direction. Based on these results, predetermined positional error correction operation is performed according to the present invention.

Specific ways of achieving the positional error correction are described next. As to the skew, the deflection mirror included in the exposure unit 11 or the exposure unit 11 itself may be changed in its inclination by means of an actuator, for example, for correcting the positional error originating from the skew. The positional error occurring due to the registration error in the sub-scan direction may be corrected by means of controlling timing of starting to write a line and controlling a surface phase in a polygon mirror, for example. The positional error due to the magnification error in the main scan direction may be corrected by means of changing a writing image frequency, for example. The positional error due to the registration error in the main scan direction may be performed by correcting timing of starting to write a main scan line.

FIG. 5 shows a set of mark series which are minimum necessary ones required for obtaining various sorts of color drift amounts in the respective colors. However, in order to cancel out fluctuation error due to rotational fluctuation of the photosensitive drums, an intermediate transfer belt (if it is applied in the system), the conveyance belt or such, another configuration may be provided for example in which, a plurality of sets of such mark series are formed during one cycle of the photosensitive drum or such, these detection marks series thus formed are then detected by means of the sensors 17, 18 and 19, and the average of the thus-obtained detection results is taken for canceling out the above-mentioned fluctuation error due to rotational fluctuation.

Thereby, it is possible to perform further accurate positional error detection.

The above-mentioned processing performed on the detected data is described in detail with reference to FIG. 6.

A signal obtained from the light receiving part 22 of each sensor 17, 18 or 19 is amplified by an amplifier 24, only a line (of the detection mark 23) detection signal component passes through a filter 25, and the thus-obtained analog data is converted into digital data by means of an A/D converter 26. Sampling of the data performed in the A/D converter 26 is controlled by a sampling control part 27. The sampled data is provided to a FIFO memory 28 from the A/D converter 26, and is stored there. After the completion of a sequence of detecting the detection marks 23, the data stored in the FIFO memory 28 is loaded in the CPU 31 and a RAM 32 by means of a data bus 30, the CPU 31 performs predetermined operation thereon, and thus the above-mentioned various sorts of error amounts are obtained.

Various sorts of programs including a program for obtaining the above-mentioned various sorts of error amounts, and other programs used for controlling the image forming apparatus according to the present invention are stored in a ROM 33. With the use of an address bus 34, a ROM address, a RAM address and various sorts of input/output devices are designated by the CPU 31.

The CPU 31 monitors the detection signals obtained from the light receiving parts 22 in the sensors 17, 18 and 19 in appropriate timing, controls respective light emission amounts in the light source units 20 so as to enable positive detection of the detection marks 23 even the light source units 20 or the conveyance belt 5 is degraded in the performance, with the use of a light emitting amount control part 35, so that a level of the light receiving signal obtained from each light receiving unit 22 may be always kept constant.

The CPU 31 and the ROM 33 act as a control part for controlling the entirety of the image forming apparatus.

In the above-described configuration, in a case where there is no cause (such as the registration error, the magnification error or such mentioned above) which causes the positional error, the detection marks 23 shown in FIG. 5 formed on the conveyance belt 5 are those formed properly in an expected manner. However, in a case where there is some cause which causes the positional error, the detection marks 23 shown in FIG. 5 formed on the conveyance belt 5 are deviated from the expected ones in their positions accordingly. Such a situation is detected by the CPU 31 as a result of the detection signals obtained from the sensors 17, 18 and 19 being sampled, stored and analyzed as described above.

An image forming apparatus in a first embodiment of the present invention is described next. The image forming apparatus in the first embodiment has a configuration described above, and, has a configuration by which a proper color drift correction or positional error correction is achievable even in a case where color drift (i.e., the above-mentioned positional error among images of the respective colors) is significantly large.

According to the first embodiment, predetermined two color drift correction modes for correcting the color drift or the positional error are provided for the purpose of coping with a situation in which the color drift is large. The color drift of the positional error is one occurring as a result of the toner images formed on the conveyance belt 5 by the toners of the respective colors, i.e., yellow (Y), magenta (M), cyan (C) and black (BK or K) as described above with reference to FIG. 1 being not precisely superposed with each other as mentioned above. These two color drift correction modes include a small positional error mode (simply referred to as a mode A) and a large positional error mode (simply referred to as a mode B). The small positional error mode or the mode A is a mode for performing correction suitable for a case where the color drift lies within a predetermined range. The large positional error mode or the mode B is a mode for performing the correction even in a case where the color drift or the positional error exceeds the predetermined range.

In a case where the color drift of the respective colors is significantly large and the color drift mainly originates from the positional error in the main scan direction, the detection marks 23 may deviate from a detectable range of each of the sensors 17, 18 and 19. In order to avoid such a situation, the CPU 31 of the image forming apparatus performs control such that each of the detecting marks 23 formed on the conveyance belt 5 may become significantly longer in the above-mentioned mode B than those formed in the above-mentioned mode A especially in the main scan direction.

On the other hand, in a case where the positional error in the sub-scan direction is significantly large, there occurs a possibility that the order of K, M, Y and C of the detection marks 23 in the respective colors formed on the conveyance belt 5 are reversed from the expected order. In order to avoid such a situation, the CPU 31 performs control such that also the spacing of these marks 23 among the respective colors, i.e., the spacing of the marks especially in the sub-scan direction is widened in the above-mentioned mode B than the same in the above-mentioned mode A.

Figure 7:
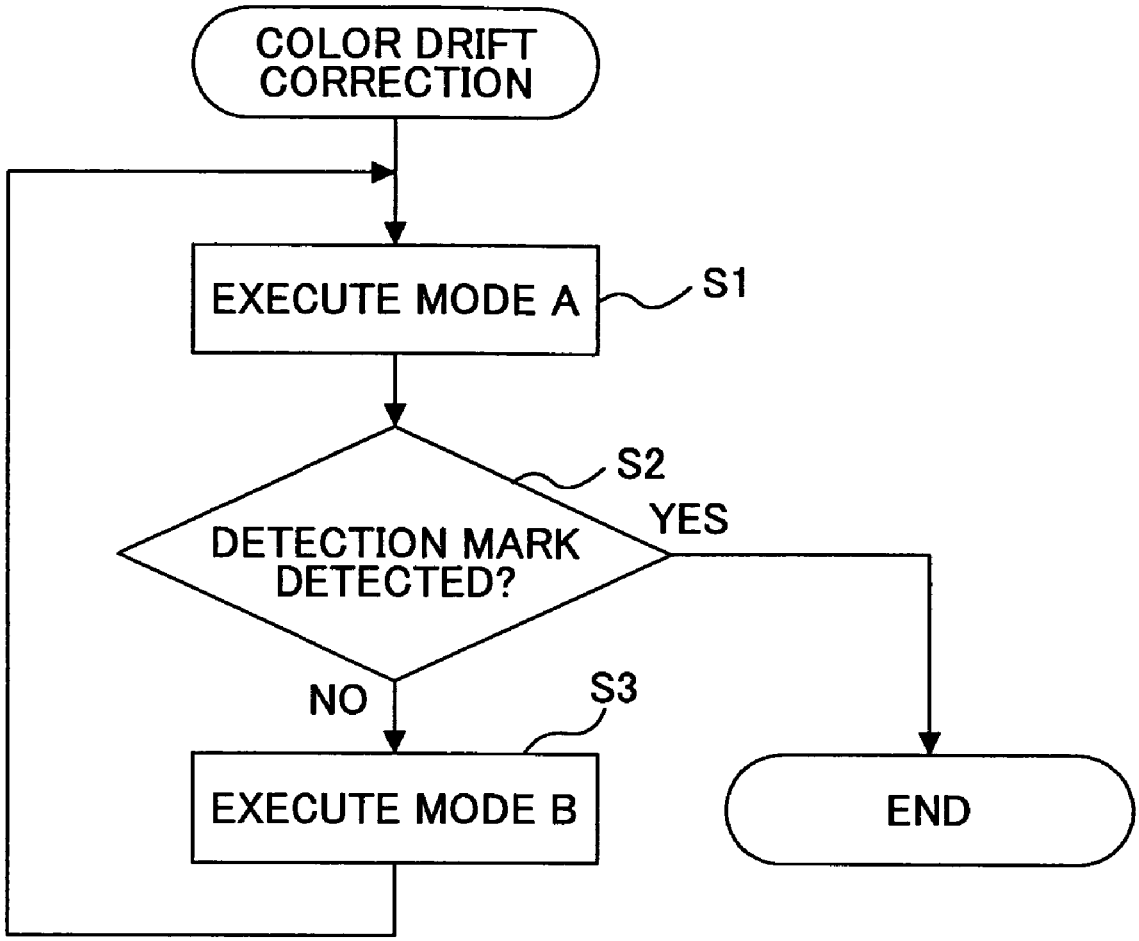
FIG. 7 shows a flow chart illustrating timing for executing a mode B after switching from a mode A according to the present invention.

FIG. 7 shows timing in which the above-mentioned mode B (in Step S3) is executed after being switched from the above-mentioned mode A (in Step S1). As shown, in a case where such a significantly large positional error among the respective colors occurs on the conveyance belt that detection of the detection marks 23 may not be achieved properly in the mode A (NO in Step S2), color drift correction is performed in the above-mentioned mode B for reducing the positional error into a range such that color drift correction control is achievable based thereon even in the mode A (in Step S3).

Thereby, even in a case where such a significantly large positional error occurs, it is possible to properly detect the lines of the detection marks 23 thus formed as a result of the lines of the detection marks 23 being formed in the manner (the lengths in the main scan direction and the spacing in the sub-scan direction thereof being increased) according to the mode B as mentioned above, and thus, the positional error detection marks 23 can be positively detected by the respective sensors 17, 18 and 19 even in such a situation.

Since the operation mode to be applied is thus determined according to the positional error amounts detected, it is possible to effectively reduce a time required for positively detecting the positional error detection marks 23 by the respective sensors 17, 18 and 19, and also, it is possible to positively detect the positional error detection marks 23.

Further, by providing a configuration in which the operation described above with reference to FIG. 7 is performed automatically by means of the CPU 31 shown in FIG. 6 or such, the color drift error detection mode is automatically changed into the above-mentioned mode B when the current positional error is determined as being significantly large. Accordingly, it is possible to minimize a time required for performing the positional error correction.

Such a significant positional error among the respective colors on the conveyance belt 5 may occur when a unit concerning image formation such as the photosensitive body unit is replaced, for example.

Accordingly, the above-mentioned change in the color drift error correction mode into the mode B from the mode A is performed in a case where it is determined that the respective error amounts which may result in the above-mentioned color drift or positional error may likely to increase, i.e., in a case where the power supply to the apparatus body is turned on, and/or, in a case where a unit such as the photosensitive body unit is replaced.

By thus providing a configuration in which, when it is determined that a significant large positional error is likely to occur, the color drift error correction mode is switched into the mode B automatically so that detection of the positional error detection marks 23 may be performed positively even in such a situation, it is possible to eliminate, during a process of correcting the positional error, a time required for actually detecting such a situation that detection of the positional error detection marks is not achievable due to a significantly large positional error, and thus, it is possible to minimize a time required for completing the process of correcting the positional error.

It is also possible to initiate the positional error correction in the mode B from at least one of a predetermined service mode or a predetermined user menu with the use of a user operation part (i.e., an operation panel or such, not shown) by a user. That is, when instructions for requesting the positional error correction in the mode B are input by means of the operation part by the user from at least one of the service mode or the user menu , the control part (CPU) first performs coarse color drift correction operation in the mode B, and after that, performs fine color drift correction operation in the mode A.

A second embodiment of the present invention is described next. According to the second embodiment, it is directed to effectively reduce a time required for performing the positional error correction in the mode B described above for the first embodiment.

A minimum necessary function of the positional error correction performed in the mode B is to control the positional error so as to reduce it into the control range of the color drift control of the mode A. Accordingly, in this case, according to the second embodiment, for the purpose of reducing the time required for the positional error detection, the lines of the positional error detection marks 23 to be formed on the conveyance belt 5 are limited to those at minimum. Specifically, a single adjustment line for the sub-scan direction and a single adjustment line for the main scan direction are formed for each of the sensors 17, 18 and 19 for each of the respective colors K, M, Y and C. For example, among the two sets of the positional error detection marks 23*a* and 23*b* shown in FIG. 5, only the single set of the marks (23*b*) should be formed.

Thus, in the mode B, the positional error correction operation is performed roughly so as to effectively reduce a time required for detecting the positional error detection marks, or to reduce a time required for performing the data processing required for the actual positional error correction processing such as that mentioned above.

Furthermore, in order to effectively reduce a time required for the positional error correction in the mode B according to the second embodiment, the control part (CPU) performs control such that a sampling period for sampling the detection signal of the light receiving part 22 in the A/D converter 26 shown in FIG. 6 is elongated in comparison to the same in the positional error correction in the mode A. Thereby, it is possible to reduce the data amount to be processed in the mode B in comparison to the same in the positional error correction in the mode A. Accordingly, it is possible to reduce a time required for the data processing in the positional error correction processing in the mode B.

Furthermore, in order to reduce a time required for the positional error correction in the coarse adjustment condition in the mode B, the driving speed of the conveyance belt 5 is increased when the positional error detection marks 23 are written to the conveyance belt by means of the image forming parts 6 in the respective colors during the positional error correction in the mode B.

Thereby, it is possible to reduce the total time required for detecting the positional error detection marks 23, and thus, to further reduce the total time required for the positional error correction.

Embodiments of the present invention are not limited to the specific embodiments described above, and variation and modification can be made as long as it lies within the scope of the present invention recited in the claims below.

For example, although the positional error detection marks 23 are formed on the conveyance belt 5 in the respective embodiments, it is also possible alternatively that the non-end moving part on which such images should be formed may be an intermediate transfer belt or such.

Further, although the slit members 21 are used in the respective embodiments, it is also possible to apply another configuration, whether or not such slit members are used, as long as it is possible to detect the positional error detection marks 23.

Furthermore, the positional error detection marks 23 are not limited to those shown in FIG. 5, and any other types of marks may be applied for the same purpose as long as they can be used to detect the positional error in the main scan direction and in the sub-scan direction. For example, marks shown in FIG. 11 of the above-mentioned Japanese Laid-open Patent Application No. 11-102098 in a chevron pattern, marks shown in FIG. 12 of the above-mentioned Japanese Laid-open Patent Application No. 11-102098 which are drawn vertically and horizontally, or such, may be applied, for example.

What is claimed is:

1. A positional error correction method for an image forming apparatus including an electrophotographic process part for image formation for an image carrying medium provided for each of a plurality of colors; a non-end moving part that moves images transferred thereto from the respective image carrying media for the respective colors; and an image detecting part that detects an image formed on said non-end moving part, wherein the respective electrophotographic process parts are disposed in sequence along said non-end moving part, and form positional error detection marks on said non-end moving part; and said image detecting part detects the thus-formed positional error detection marks, said method comprises the steps of:

a) performing positional error correction based on a result of detection thus performed by said image detecting part; and b) performing at least one of a first positional error mode which uses first positional error detection marks and a second positional error mode which uses second positional error detection marks, wherein after said first positional error mode is performed, a determination is made as to whether or not said first positional error detection marks have been properly detected, and when the positional error detection marks have not been properly detected, said second positional error mode, said first positional error mode and said determination are performed in this order until said determination indicates that said first positional error detection marks have been properly detected.

2. The positional error correction method as claimed in claim 1, wherein:

said first positional error mode comprises a small positional error mode which is applied when a positional error amount is small and said second positional error mode comprises a large positional error mode which is applied when the positional error amount is large; and in said large positional error mode, control is performed such that the positional error detection marks formed by the respective electrophotographic process parts are longer or have longer spacing there among than those in said small positional error mode.

3. The positional error correction method as claimed in claim 1, wherein:

said at least two modes of positional error correction are executed from at least one of a service mode and a user menu.

4. The positional error correction method as claimed in claim 2, wherein:

control is performed such that said large positional error mode is executed automatically at predetermined timing.

5. The positional error correction method as claimed in claim 4, wherein:

said predetermined timing comprises at least either one of timing immediately after a power supply to a body part of said apparatus is turned on and timing immediately after a predetermined unit concerning image formation in said apparatus is replaced.

6. The positional error correction method as claimed in claim 2, wherein:

said image detecting part comprises a light source and a light receiving part; and control is performed such that an output signal of said light receiving part is sampled with a longer period when the positional error detection marks are detected by said image detecting part in the large positional error mode than that in the small positional error mode.

7. The positional error correction method as claimed in claim 2, wherein:

control is performed such that a speed at which the non-end moving part moves when the electrophotographic process parts form the positional error detection marks on the non-end moving part is higher in the large positional error mode than that in the small positional error mode.

8. A positional error correction method for an image forming apparatus comprising an electrophotographic process part for image formation for an image carrying medium provided for each of a plurality of colors, a non-end moving part that moves images transferred thereto from the respective image carrying media for the respective colors; and an image detecting part that detects an image formed on said non-end moving part, wherein the respective electrophotographic process parts are disposed in sequence along said non-end moving part, and form positional error detection marks on said non-end moving part; and said image detecting part detects the thus-formed positional error detection marks, said method comprising the steps of:

a) performing positional error correction based on a result of detection thus performed by said image detecting part; and b) performing a small positional error mode when a positional error amount is small and a large positional error mode when the positional error amount is large, wherein after said small positional error mode is performed, a determination is made as to whether or not said positional error detection marks have been properly detected, and, when the positional error detection marks have not been properly detected, said large positional error mode is performed.

9. The positional error correction method as claimed in claim 8, wherein:

in said large positional error mode, control is performed such that the positional error detection marks formed by the respective electrophotographic process parts are longer or have longer spacing there among than those in said small positional error mode.

10. The positional error correction method as claimed in claim 8, wherein:

said at least two modes of positional error correction are executed from at least one of a service mode and a user menu.

11. The positional error correction method as claimed in claim 9, wherein:

control is performed such that said large positional error mode is executed automatically at predetermined timing.

12. The positional error correction method as claimed in claim 11, wherein:

said predetermined timing comprises at least either one of timing immediately after a power supply to a body part of said apparatus is turned on and timing immediately after a predetermined unit concerning image formation in said apparatus is replaced.

13. The positional error correction method as claimed in claim 9, wherein:

said image detecting part comprises a light source and a light receiving part; and control is performed such that an output signal of said light receiving part is sampled with a longer period when the positional error detection marks are detected by said image detecting part in the large positional error mode than that in the small positional error mode.

14. The positional error correction method as claimed in claim 9, wherein:

control is performed such that a speed at which the non-end moving part moves when the electrophotographic process parts form the positional error detection marks on the non-end moving part is higher in the large positional error mode than that in the small positional error mode.

15. A positional error correction method for an image forming apparatus comprising an electrophotographic process part for image formation for an image carrying medium-provided for each of a plurality of colors; a-non-end moving part that moves images transferred thereto from the respective image carrying media for the respective colors; and an image detecting part that detects an image formed on said non-end moving part, wherein the respective electrophotographic process parts are disposed in sequence along said non-end moving part, and form positional error detection marks on said non-end moving part; and said image detecting part detects the thus-formed positional error detection marks, said method comprising the steps of:

a) performing positional error correction based on a result of detection thus performed by said image detecting part; and b) performing at least one of a first positional error mode which uses first positional error detection marks and a second positional error mode which uses second positional error detection marks, wherein said first positional error mode comprises a small positional error mode which is applied when a positional error amount is small and said second positional error mode comprises a large positional error mode which is applied when the positional error amount is large; and in said large positional error mode, control is performed such that the positional error detection marks formed by the respective electrophotographic process parts are longer than those in said small positional error mode such that the positional error marks can be positively detected by said image detecting part.

16. The positional error correction method as claimed in claim 15, wherein:

said at least two modes of positional error correction are executed from at least one of a service mode and a user menu.

17. The positional error correction method as claimed in claim 15, wherein:

control is performed such that said large positional error mode is executed automatically at predetermined timing.

18. The positional error correction method as claimed in claim 17, wherein:

said predetermined timing comprises at least either one of timing immediately after a power supply to a body part of said apparatus is turned on and timing immediately after a predetermined unit concerning image formation in said apparatus is replaced.

19. The positional error correction method as claimed in claim 15, wherein:

said image detecting part comprises a light source and a light receiving part; and control is performed such that an output signal of said light receiving part is sampled with a longer period when the positional error detection marks are detected by said image detecting part in the large positional error mode than that in the small positional error mode.

20. The positional error correction method as claimed in claim 15, wherein:

control is performed such that a speed at which the non-end moving part moves when the electrophotographic process parts form the positional error detection marks on the non-end moving part is higher in the large positional error mode than that in the small positional error mode.

* * * * *